United States Patent [19]

Arkell

[11] 4,005,653

[45] Feb. 1, 1977

[54] VACUUM CYLINDER FOR PRINTING PRESSES

[75] Inventor: William C. Arkell, Cornwall, England

[73] Assignee: Livermore and Knight Co., Inc., Palm Beach, Fla.

[22] Filed: Sept. 9, 1974

[21] Appl. No.: 504,254

[52] U.S. Cl. ..... 101/382 MV; 101/415.1

[51] Int. Cl.[2] ..... B41F 27/06; B41F 27/12

[58] Field of Search ..... 101/382 MV, 415.1, 378; 269/21; 248/363

[56] References Cited

UNITED STATES PATENTS

| | | | |
|---|---|---|---|
| 1,763,124 | 6/1930 | Barber | 101/378 |
| 2,317,348 | 4/1943 | Wekeman | 248/363 |
| 2,417,496 | 3/1947 | Huebner | 101/382 MV |
| 2,753,181 | 7/1956 | Anander | 269/21 X |
| 3,078,796 | 2/1963 | Kamata et al. | 101/378 |
| 3,112,698 | 12/1963 | Lake | 101/382 X |
| 3,146,709 | 9/1964 | Bass et al. | 101/378 X |
| 3,222,051 | 12/1965 | Bevilacqua et al. | 269/21 |
| 3,294,392 | 12/1966 | Dunham | 269/21 |
| 3,335,994 | 8/1967 | Cocito | 248/363 |
| 3,353,481 | 11/1967 | Antonucci | 101/415.1 X |
| 3,406,938 | 10/1968 | Muir, Jr. | 248/363 |
| 3,512,487 | 5/1970 | Kranz et al. | 248/363 X |
| 3,536,009 | 10/1970 | Boehm | 101/415.1 |

FOREIGN PATENTS OR APPLICATIONS

| | | | |
|---|---|---|---|
| 1,038,567 | 9/1958 | Germany | 101/382 MV |
| 484,169 | 5/1938 | United Kingdom | 101/378 |

*Primary Examiner*—J. Reed Fisher
*Attorney, Agent, or Firm*—Mandeville and Schweitzer

[57] ABSTRACT

The disclosure relates to an improved form of vacuum-operated printing cylinder for a printing press, providing a practical means for holding the printing plate on the cylinder by vacuum alone, without requiring separate adhesive means and/or supplementary mechanical devices for clamping the plate. In the preferred form, the cylinder includes a supporting shaft mounting, between its bearing portions, a plurality of cylinder supporting rings. A cylinder sleeve is supported by the rings and forms, together with the rings and the supporting shaft, a hollow cylinder structure having a plurality of vacuum chambers. The interior of the cylinder can be evacuated from one end of the shaft, and independently controllable valve means are built into the cylinder, to enable the several chambers thereof to be independently evacuated. In one form of the invention, the cylinder sleeve is provided with a large number of radial passages, providing communication to the outside surface of the cylinder. In another form, the sleeve is provided with a plurality of axially spaced, continuous annular grooves, which communicate at one or more places with the interior of the cylinder. The continuous grooves are blocked off at one or more places around the circumference of the cylinder to avoid leakage at the end-to-end discontinuity in a printing plate supported on the cylinder.

6 Claims, 12 Drawing Figures

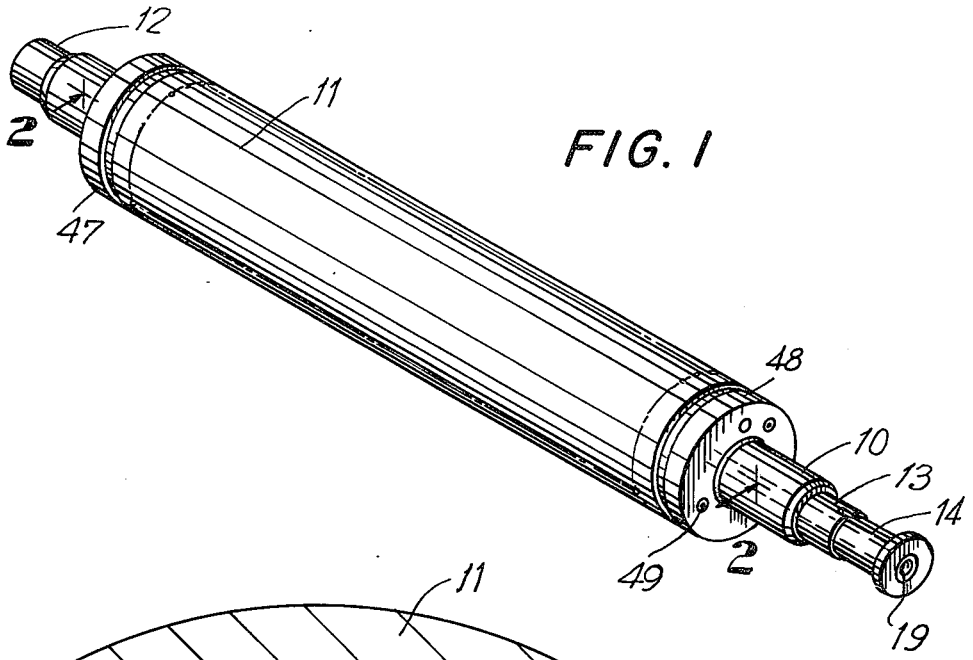
FIG. 1
FIG. 3
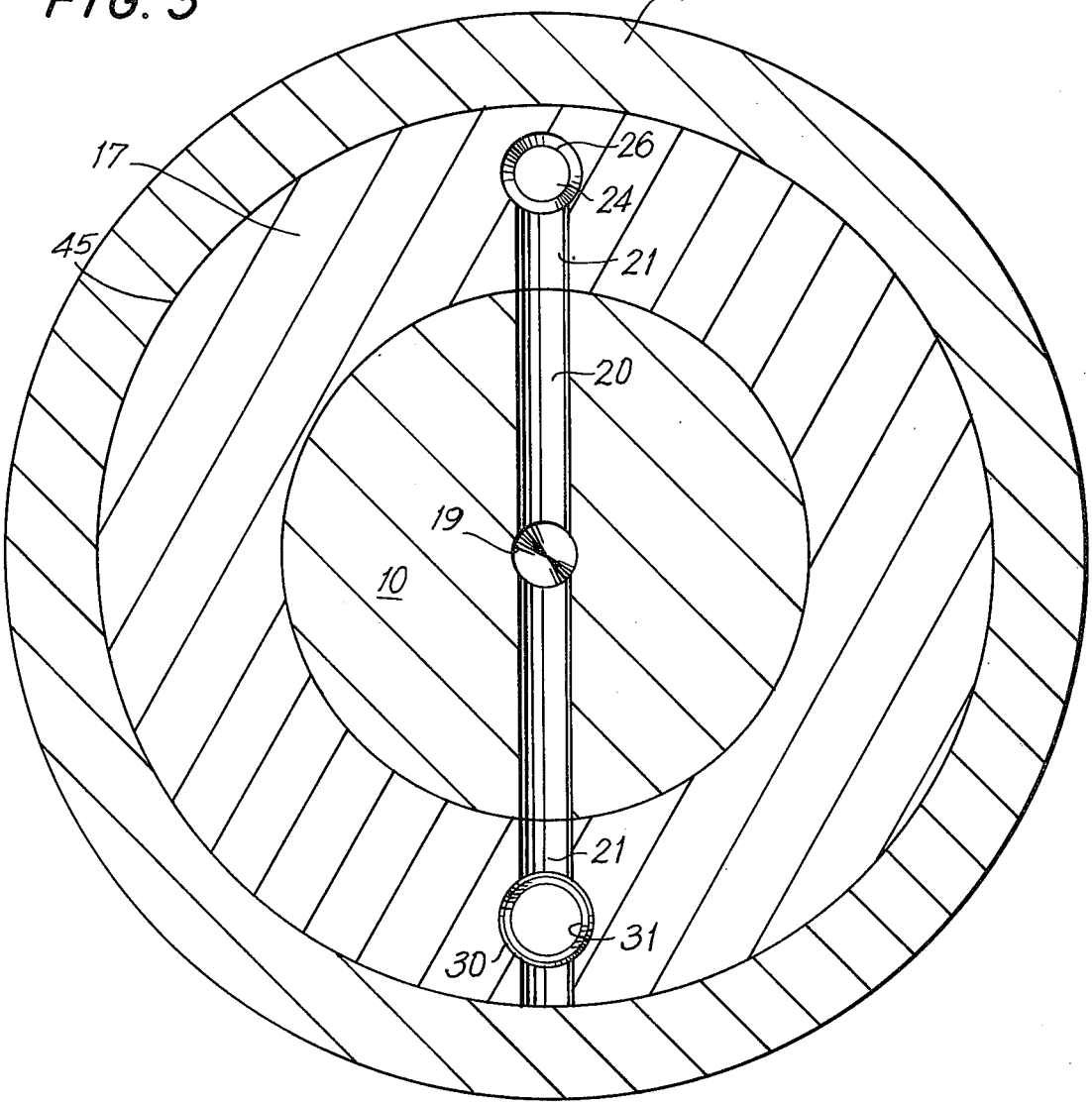

VACUUM CYLINDER FOR PRINTING PRESSES

BACKGROUND AND SUMMARY OF THE INVENTION

Rotary printing machines, such as rotary offset lithographic machines, for example, utilize printing cylinders to which printing plates are conformed and secured. The printing plates rotate with the cylinders and apply the desired impression to a rubber covered blanket cylinder, which then transfers the impression to a sheet or web passed between the blanket cylinder and an opposing roll or plate. Typically, means are provided on the printing cylinder for mechanically engaging one or both ends of the printing plate in order to keep the plate properly positioned on the cylinder. Commonly, this is done by providing means for clamping the ends of the printing plate. In some cases, adhesive is utilized, alone or in conjunction with other means, to hold the printing plates in position.

It has been proposed heretofore to utilize vacuum means to retain the printing plates in position on the printing cylinders. Representative of prior proposals for this purpose are the Johnson et al U.S. Pat. No. 2,060,082, the Lake U.S. Pat. No. 3,112,698, the Musgrave U.S. Pat. No. 3,380,381, and the Demaria et al U.S. Pat. No. 3,463,476. The theoretical advantages of the vacuum cylinder are evident, in that it is expected to be able to more easily mount printing plates thereon. Changing of printing plates is also expected to be facilitated. However, notwithstanding the expected advantages to be derived from the vacuum cylinder, its commercial acceptance has been extremely limited, because of the practical difficulties experienced in achieving an effective design of a vaccum cylinder suitable for use under conditions of day to day commercial production.

As its basic objective, the present invention seeks to provide a novel and improved design and construction of a vacuum-operated printing cylinder suitable for utilization under conditions of typical commercial production and which does not require the use, in conjunction with the vaccum holding means, of mechanical or other auxiliary holding means to assist in securing the printing plate on the face of the cylinder.

Principal structural elements of the new vacuum-operated printing cylinder include (a) an elongated supporting shaft extending from one end to the other of the cylinder and sufficiently beyond to provide bearing support, (b) a plurality of cylinder supporting rings secured in axially spaced relation on the bearing shaft, and (c) a hollow cylinder sleeve secured to the supporting rings and forming therewith one or more (advantageously a plurality) of vacuum chambers within the printing cylinder. The supporting shaft and rings are provided with internal passages for the evacuation of the internal chambers. To particular advantage, independent valve means are provided for selectively evacuating all or less than all of the plurality of chambers of the vacuum cylinder, so that small size printing plates may be readily utilized and/or so that printing plates may be removed and replaced from part of the cylinder surface, without disturbing other plates secured by vacuum in adjacent areas.

In the improved vacuum-operated printing cylinder of the invention, an effective balance is provided with respect to the amount and distribution of exposed vacuum area on the outer surface of the cylinder, such that adequately distributed vacuum holding power is available to secure the printing plates, while at the same time minimizing leakage, which would reduce the overall holding effectiveness of the cylinder. In some forms of the new printing cylinders, vacuum communication is provided by appropriately distributed small radial bores. In other forms, discontinuous annular grooves are provided. And in still other forms, means are provided for diffusing the vacuum over the surface of the cylinder.

Pursuant to the invention, certain construction of the new vacuum cylinder utilize a plurality of independent vacuum chambers. Such structures advantageously utilize a combination of internal piping and bored passages in the supporting shaft, to provide communication between the vacuum source and the respective individual chambers. In addition, each such individual chamber is provided with a manually accessible valve arrangement, enabling the chamber to be isolated from the vacuum source where desired. Thus, if only a portion of the surface of cylinder is to be covered by the printing plate, the otherwise exposed portions of the cylinder surface may be isolated from the vacuum source to prevent excessive leakage.

In part, the invention is directed to improved and advantageous structural features for a vacuum-operated printing cylinder, which simplify and improve its construction. One such feature relates to the provision of a plurality of axially spaced support rings, each of slightly increasing diameter from one end to the other of the cylinder assembly. The outer cylinder sleeve member, which is supported by the rings, is in turn provided with shouldered bearing areas of progressively increasing diameter. The arrangement is such that the outer cylinder sleeve may be applied axially over the pre-assembled shaft and support rings, achieving a force fit therewith only over the last inch or so of axial assembly. Thus, the final assembly of the principal elements is relatively convenient and straightforward. At the same time, however, the airtight integrity of the various vacuum chambers is easily maintained.

In accordance with one of the more specific aspects of the invention, in the form of the new vacuum-operated cylinder in which vacuum distribution is effected by means of annular grooves in the cylinder, an improved and simplified arrangement is provided for blocking off or dead ending the grooves to avoid leakage the ends of a vacuum-held printing plate. In this respect, after first forming continuous annular grooves in the printing cylinder, the cylinder is provided with a longitudinally extending surface groove, which is continuous from one end to the other of the cylinder. A soft metal strip is then tightly received in the longitudinal groove, to effectively block off all of the annular grooves and provide a predetermined circumferential discontinuity between adjacent ends of each groove. While it is known in the prior art to provide means for individually dead ending the annular grooves (e.g. Lake U.S. Pat. No. 3,112,698), the arrangement of the invention is considered to be more simplified and versatile than the prior art proposals.

In accordance with other specific aspects of the invention, the vacuum-operated printing cylinders, otherwise as described above, may additionally be provided with vacuum diffusion means over the outer surface areas, in the form of porous filter media or sintered, porous surface coatings. The use of porous filter media is particularly advantegeous for some applications, in that coverings of filter paper may be provided in various thicknesses, to compensate for different thicknessess of the printing plates which may be utilized by the printer. When using vacuum diffusion means, less consideration need be given to minimizing or avoiding leakage beyond the edges of the printing plate, because the diffusing mediums easily limits such leakage to amounts within the capacity of vacuum pumps typically used for the purpose.

For a better understanding of the above and other features and advantages of the invention, reference should be made to the following detailed description and the accompanying drawing.

DESCRIPTION OF THE DRAWING

FIG. 1 is a perspective view of a vacuum-operated printing cylinder incorporating the features of the invention.

FIGS. 3 and 4 are cross sectional views taken generally on lines 3—3, 4—4 respectively of FIG. 2.

DESCRIPTION OF PREFERRED EMBODIMENTS OF THE INVENTION

Figure 2:
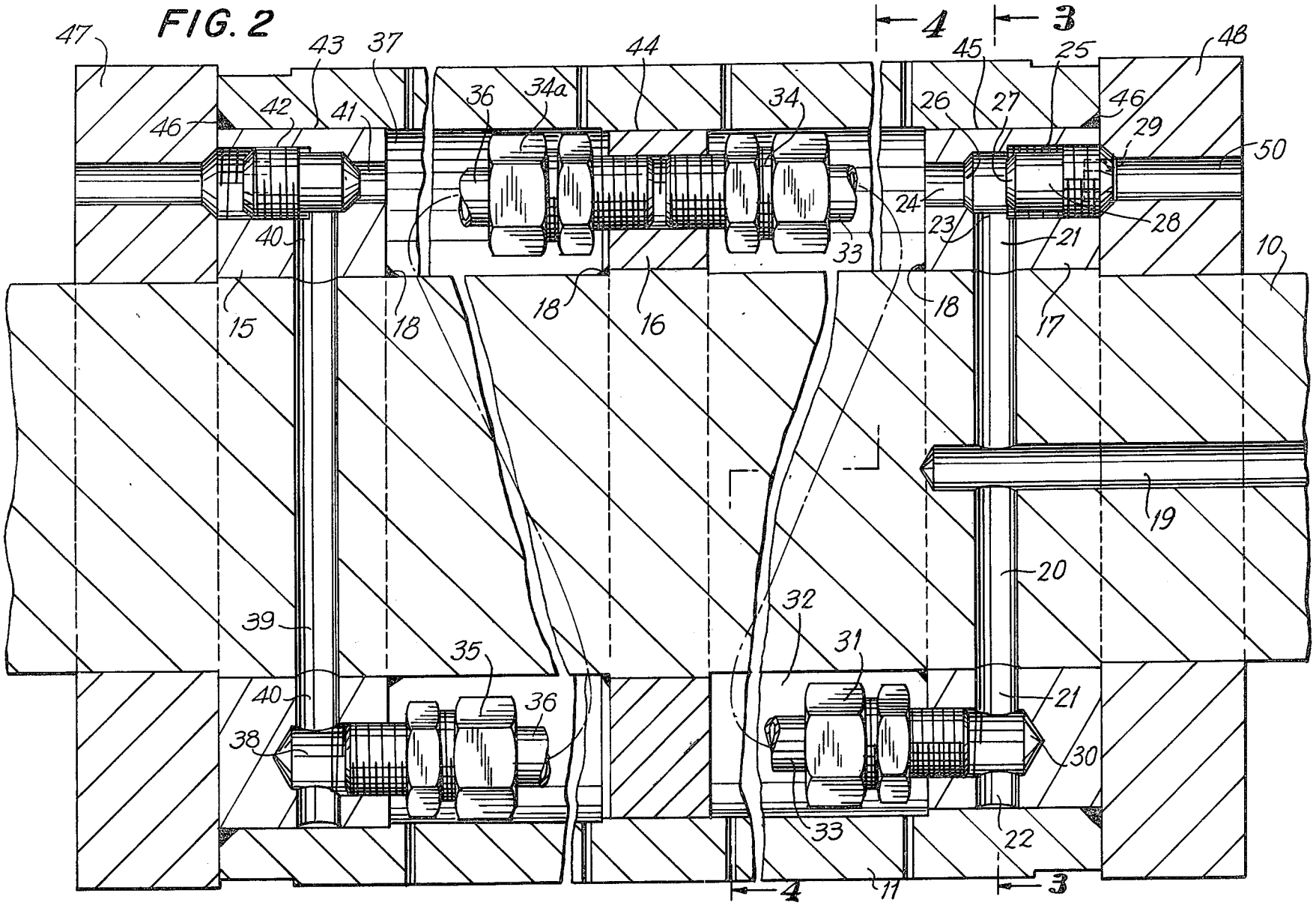
FIG. 2 is a greatly enlarged, fragmentary cross sectional view taken generally along line 2-2 of FIG. 1, illustrating details of the internal construction of the new vacuum-operated printing cylinder.
Figure 4:
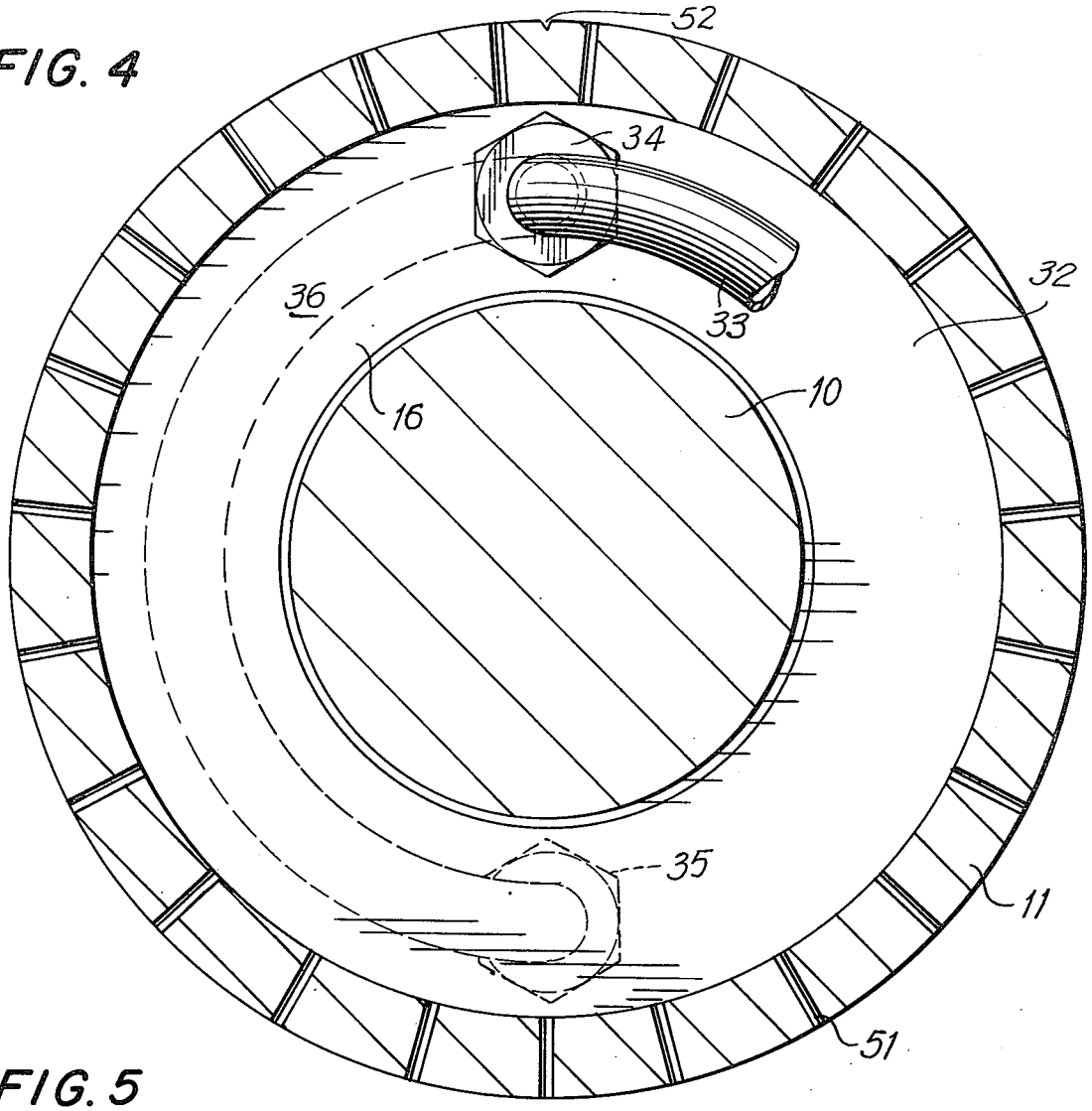
Figure 5:
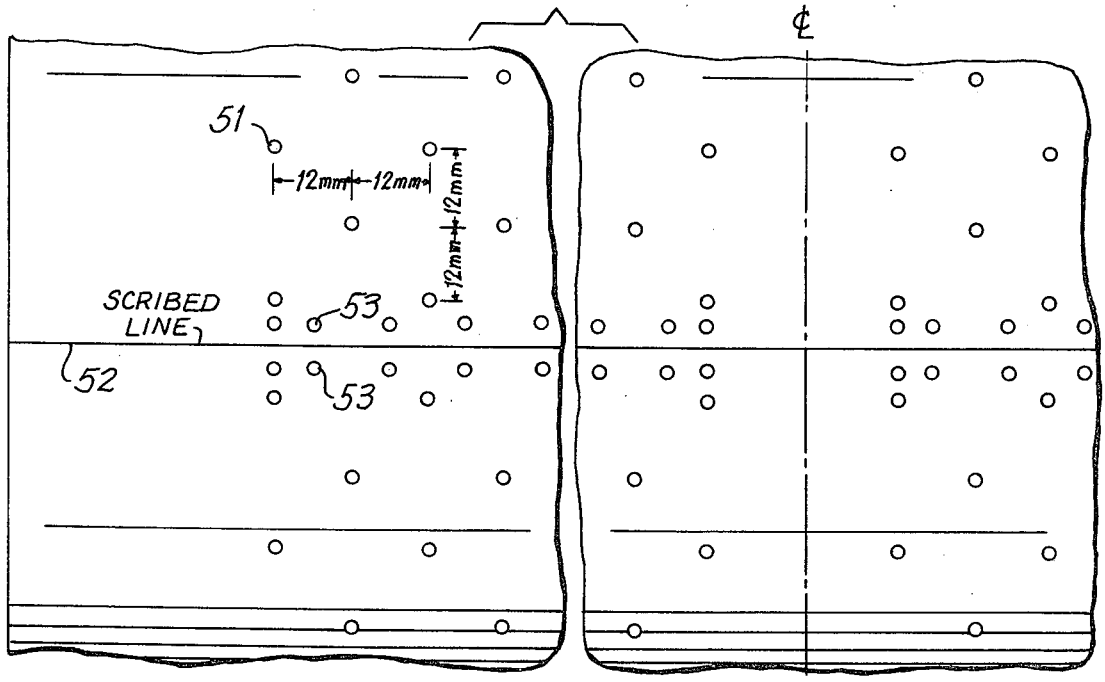
FIG. 5 is an enlarged, fragmentary view illustrating a portion of the outer surface of the cylinder of FIG. 1 and 2, showing typical distribution of vacuum passages in the surface of the cylinder.

Referring now to the drawing, and initially to FIGS. 1-5 thereof, the reference numeral 10 designates generally an elongated shaft of a length suitable to extend through an entire cylinder sleeve 11 and project somewhat beyond either end thereof. Adjacent each end of the cylinder sleeve, the shaft 10 is provided with bearing areas 12, 13, by means of which the shaft is supported in the printing machine (not shown) is a conventional and well known manner. One end of the shaft is provided with a key way 14, by means of which the shaft may be driven in properly times relation with the printing equipment.

In the first illustrated form of the invention, the shaft 10 is provided in its mid region with a plurality of axially spaced supporting rings 15–17. While it is to be understood that the present invention is not in any way limited to specific dimensions, a typical printing cylinder assembly incorporating features of the invention may have a working length of, for example, around 90 cm between the outer surfaces of the support rings 15, 17 at opposite ends, with the center supporting ring 16 being located approximately midway between the end rings. Likewise, for a typical such printing cylinder incorporating features of the invention, the overall outside diameter of the cylinder sleeve 11 may be on the order of 18 cm, in which case it may be convenient to construct the shaft 10 to have a diameter on the order of, say, 9 cm in its center region. To advantage, the support rings 15–17 are welded to the shaft 10, as reflected at 18.

The shaft 10 is provided at one end witn an elongated axial bore 19, which is arranged to be connected at the outer end of the shaft by an appropriate rotary coupling (not shown), to a vacuum pump. In the region of the shaft 10 on which the supporting ring 17 is mounted, the shaft and ring are provided with a transverse bore 20-21 intersecting with the axial bore 19. The bore 20-21 may be formed after assembly of the supporting ring 17 onto the shaft. The bore 20-21 thus enters the support ring 17 at one side 22 and is dead ended at the other side 23. The open end 22 may be plugged, if desired, but typically will be effectively sealed off by the inner wall of the cylinder sleeve 11.

At one side, the bore 20-21 is connected to a longitudinal through bore 24, extending from one end to the other of the support ring 17. On its outer or right hand side, the bore 24 is enlarged and threaded, as at 25. At its opposite end the axial through bore 24 is provided with a conical seat 26 arranged for cooperation with a corresponding conical surface 27 on a threaded valve plug 28. The valve plug 28 is threadedly received in the threaded portion 25 of the through bore 24, and typically may be provided with a socket 29 for the reception of an Allen wrench. When the valve plug 28 is in a retracted position, as shown at the right hand side of FIG. 2, communication is provided between the axial passage 19, the transverse bore 20-21, and the upstream or left hand extremity of the longitudinal through bore 24. When the valve plug 28 is screwed to a closed position, with the conical seats 26, 27 in engagement, the upstream end of the passage 24 is isolated from the main passaged 19.

At the diametically opposite side of the support ring 17, a blind bore 30 is provided, communicating with the bore 20-21 and opening at the left side of the support ring. This bore is threaded to received a union fitting 31 within the annular chamber 32 formed between the shaft 10, the support rings 16, 17, and the cylinder sleeve 11. The union fitting 31 is connected to a section of tubing 33, preferably of a semi-rigid material, such as copper. The tubing 33 is bent in a configuration to extend within the annular chamber 32 over an arc of about 180°, passing around the center shaft 10 and connecting at the opposite side of the shaft to a second union fitting 34. The union fitting 34, and a similar union fitting 34*a*, are secured within a threaded through bore in the center support ring 16, providing communication through the ring 16, which otherwise is maintained in airtight relation to the shaft 10 and to the cylinder sleeve 11.

A second section 36 of semi-rigid tubing extends around the center shaft 10 within an annular chamber 37 defined by the supporting rings 15, 16, the shaft 10 and the cylinder sleeve 11. The tubing 36 extends around the shaft 10 on the opposite side from the tubing 33, so that the respective tubing sections counterbalance each other, and the tubing 36 connects at the opposite side of the assembly to a union fitting 35.

The union fitting 35 is secured in a threaded, dead end bore 38, which intersects with a bore 39-40 extending transversely through the support ring 15 and shaft 10. At the opposite end of the bore 39-40, is a longitudinal through bore 41, similar to the bore 26, which receives a threaded valve plug 42 similar to the valve plug 28 at the opposite end. The valve plug 42 is shown in its closed position, in which the annular chamber 37 is isolated from the bore 39-40. Opening of the valve plug places the chamber 37 in communication with the main axial passage 19, at the other end of the shaft, through the spirally disposed tubing sections 33, 36, as will be understood.

As reflected in FIG. 2 in particular, the cylinder sleeve 11 is formed with internal cylindrical surfaces 43-45 which engage tightly with and are supported by the respective supporting rings 15–17. Desirably, the cylinder sleeve 11 is arranged to form an interference fit with the respectively supporting rings 15–17, to assure substantial airtight integrity of the annular chambers 32, 37.

To advantage, the several supporting rings 15-17 are of progressively slightly increasing diameter from one end to the other of the assembly. By way of example only, in an assembly in which the support rings 15-17 are nominally around 15–16 cm in diameter, the rings 16, 17 may progressively increase in diameter by, for example, around 0.25 mm. In a similar manner, the inside diameter of the respective supporting surfaces 43–45 of the cylinder sleeve increase correspondingly in diameter.

In assembling the vacuum cylinder of the invention, a pre-assembly is made of the shaft 10, support rings 15-17, the tubing sections 33, 36, and the various union fittings. The pre-machined cylinder sleeve 11 is then applied axially over the described pre-assembly, from right to left as viewed in FIG. 2. The left hand end of the cylinder sleeve, being of the largest diameter, readily clears the support rings 17 and 16, enabling the sleeve to be slid easily into position, until the last inch or so of the assembly, where inference commences between the surfaces 43-45 and the rings 15-17. Thereafter, adequate axial force, accompanied if necessary by heating of the cylinder sleeve and/or cooling of the pre-assembly, is utilized to force the sleeve axially into its final, assembled position, as reflected in FIG. 2. Desirably, the outer joint between the end most support rings 15-17 and the cylinder sleeve 11 may be welded, as reflected at 46, to secure the assembly.

Consistent with conventional printing practice, the printing cylinder is provided at each end with bearer rings 47, 48, secured adjacent the ends of the printing cylinder and having an outside diameter slightly greater than that of the cylinder sleeve 11 to provide a predetermined clearance space underneath the cylinder to accommodate the printing plate. The bearer rings 47, 48 may be secured to the support rings 15, 17 by suitable bolts 49 (FIG. 1). In addition, each of the bearer rings is provided with an opening 50, aligned with the respective valve plugs 28, 42, providing access for an Allen wrench or similar tool, for manipulating the valve plugs between their opened and closed positions.

In the form of the invention illustrated in FIGS. 1–5, the cylinder sleeve 11 is provided with a plurality of radial bores 51 distributed over the surface of the cylinder sleeve, in the region of the respective chambers 32, 37. In a typical commercial printing cylinder having representative dimensions as herein before mentioned, the radial bores 51 may have a diameter on the order of 1.6 mm and may be spaced in stagered rows, spaced apart about 12 mm in a circumferential direction and a similar distance in the axial direction. At a selected point on the circumference of the cylinder sleeve, an axially disposed locating line 52 is scribed, to assist in lining up the end s of a printing plate. In this region, additional rows of bores 53 are provided to give increased holding power adjacent the edges of the plate.

In the operation of the cylinder assembly of FIGS. 1–5, vacuum is applied to the cylinder surface by connecting a vacuum pump to the axial passage 19 in the shaft and opening one or both of the valve plugs 28, 42 to evacuate either or both of the chambers 32, 37. In a typical case, a flexible printing plate will be cut to a size suitable to cover the entire operating surface of the cylinder — that is, the surface over which the radial bores 51, 53 are provided. Thus, the plate could extend axially over substantially the entire area between the inside surfaces of the supporting rings 15, 17. In a circumferential direction, the printing plate would extend from the scribed line 52, around the cylinder and back to a point close to but slightly space from the scribed line. The arrangement and spacing and sizing of the radial bores 51, 53 is such that, in commercial practice, a printing plate may be effectively held on the printing cylinder by a vacuum alone, without the use of adhesives and without the use of mechanical clamping means.

Where appropriate, the printing cylinder may be activated or de-activated incrementally, by means of the valve plugs 28, 42. This may be utilized to significant advantage and convenience when utilizing printing plates of less than full size. In this respect, it will be understood that, while the assembly illustrated in FIGS. 1–5 is provided with two independently activated chambers 32, 37, by appropriate internal piping of the assembly, any number of independently usable chambers could be provided.

Figure 7:
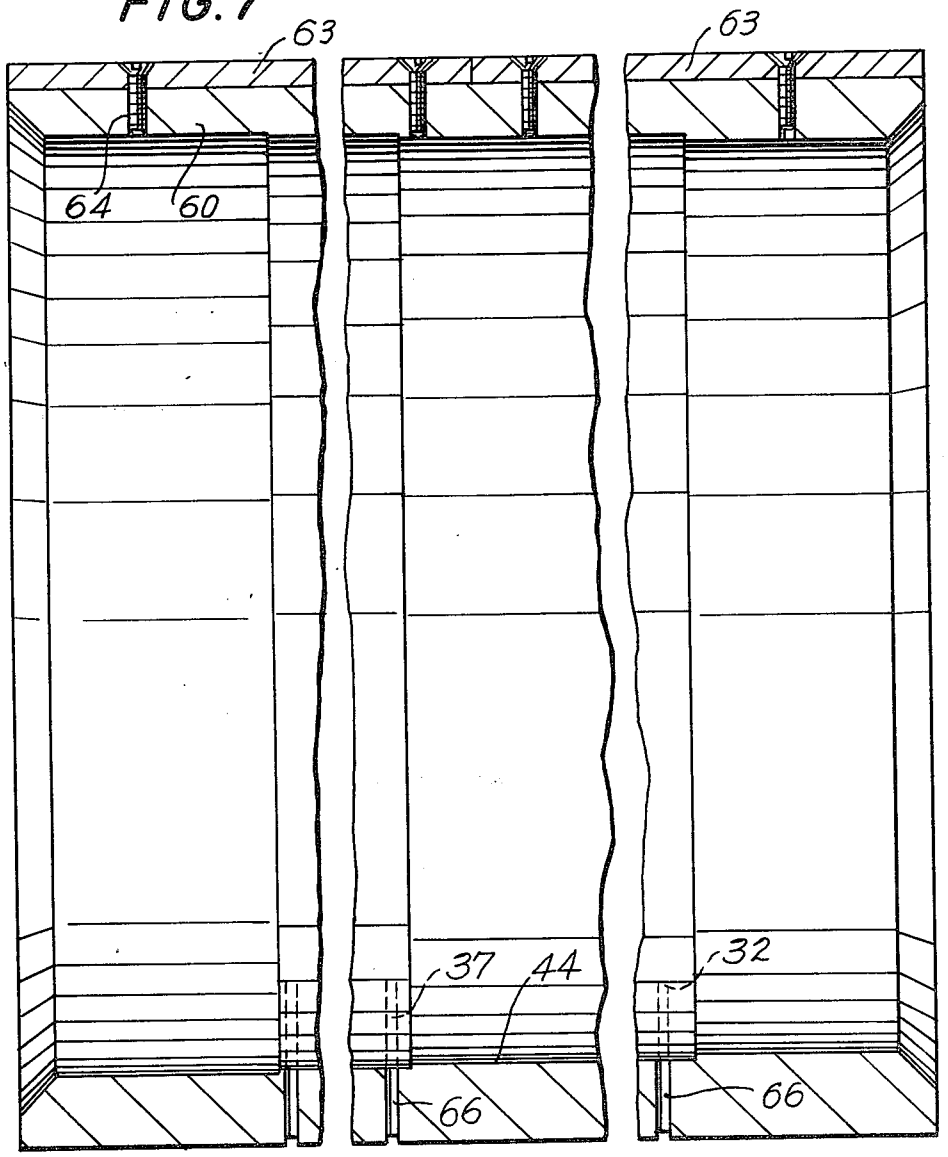
FIG. 7 is a cross sectional view taken generally on line 7—7 of FIG. 6.
Figure 6:
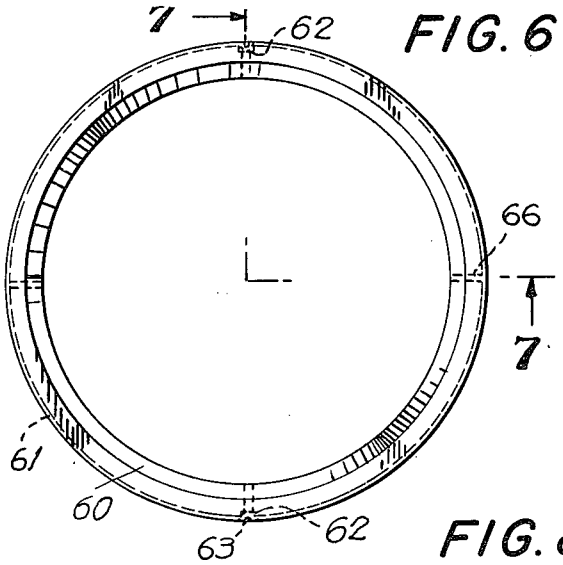
FIG. 6 is an end elevational view of the cylindrical outer section only of a modified form of the new printing cylinder, in which vacuum distribution is provided by annular grooves.
Figure 8:
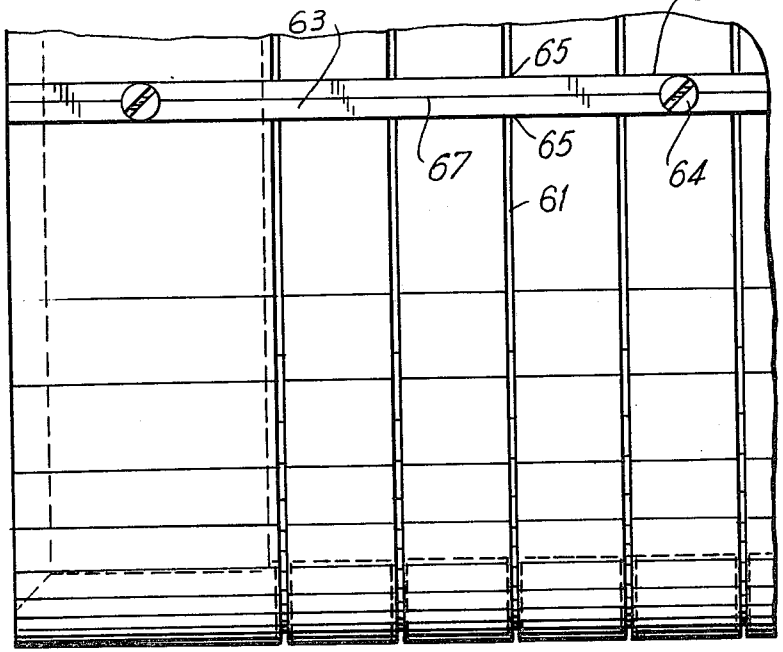
FIG. 8 is a fragmentary side view of the cylinder section of FIG. 6.

In the form of the invention, illustrated in FIGS. 6–8, the cylinder sleeve 60 is provided with a series of annular grooves 61, spaced across the working length of the cylinder sleeve, to provide vacuum communication to the underside of the printing plate. In all other respects, the grooved printing cylinder assembly may be similar to that illustrated in FIGS. 1–5, and therefore the internal structure of the shaft and supporting ring pre-assembly, internal passages and plumbing, etc. is omitted with respect to the embodiment of FIGS. 6–8, and only the cylinder sleeve itself is described.

In a vacuum printing cylinder of the proportions heretofor mentioned, the cylinder sleeve 60 may have on the order of 40–45 annular grooves of a typical width of about 0.75 mm.

In accordance with a specific aspect of the invention, the grooves 61 initially are formed by machining continuous annular grooves in the surface of the cylinder sleeve. In conjunction with these annular grooves 61, the sleeve is provided with one, and preferably a pair, of longitudinally extending surface grooves 62. Ideally, a pair of grooves 62 is provided, located diametrically opposite on the surface of the cylinder, as reflected in FIG. 6. The longitudinal grooves 62 are cut somewhat deeper than the annular grooves 61, and also have a somewhat greater width. Thus, typically, the axial grooves 62 may have a width of around 6.4 mm and a depth on the order of 3.1 mm. The annular grooves, on the other hand, may have a typical depth of about 0.9 mm.

Received in the axial grooves 62 are soft metal strips 63, which extend the full length of the cylinder sleeve 60 and typically are segmented. These strips are secured to the cylinder by a plurality of recessed screws 64, and are machined flush with the outer surface of the cylinder sleeve. The soft metal strip 63 are sufficiently tightly received in the grooves 62 to seal off the end areas 65 of the annular grooves 61, so that the grooves extend effectively over somewhat less than 180° of the cylinder surface.

At some point along each semi-annular grooves segment, typically and advantageously halfway between its ends, a radial bore 66 is provided, placing the grooves in communication with the interior annular chambers 32, or 37 of the cylinder assembly. The bore 66 typically may be on the order of 1.6 mm in diameter.

Operation of the grooved cylinder modification of the invention is similar to that of the modification of FIGS. 1–5. The chambers 32, 37 may be independently activated, by means of the valve plugs 28, 42 (see FIG. 2), so that different axial sections of the printing cylinder may be utilized. The printing plate is cut to extend around the full circumference of the cylinder, with one end being initially placed in alignment with a scribed axial line 67 and the other end ideally overlying the longitudinal sealing strip 63 with a slight clearance space from the scribed line 67, so that the two ends do not overlap. By providing for the sealing strip 63 to have a reasonable width (e.g. 6.3 mm) small margins of the printing plate, at each end, may overlap on the sealing strip, substantially avoiding air leakage in the regions of the end areas 65 of the annular grooves.

Figure 9:
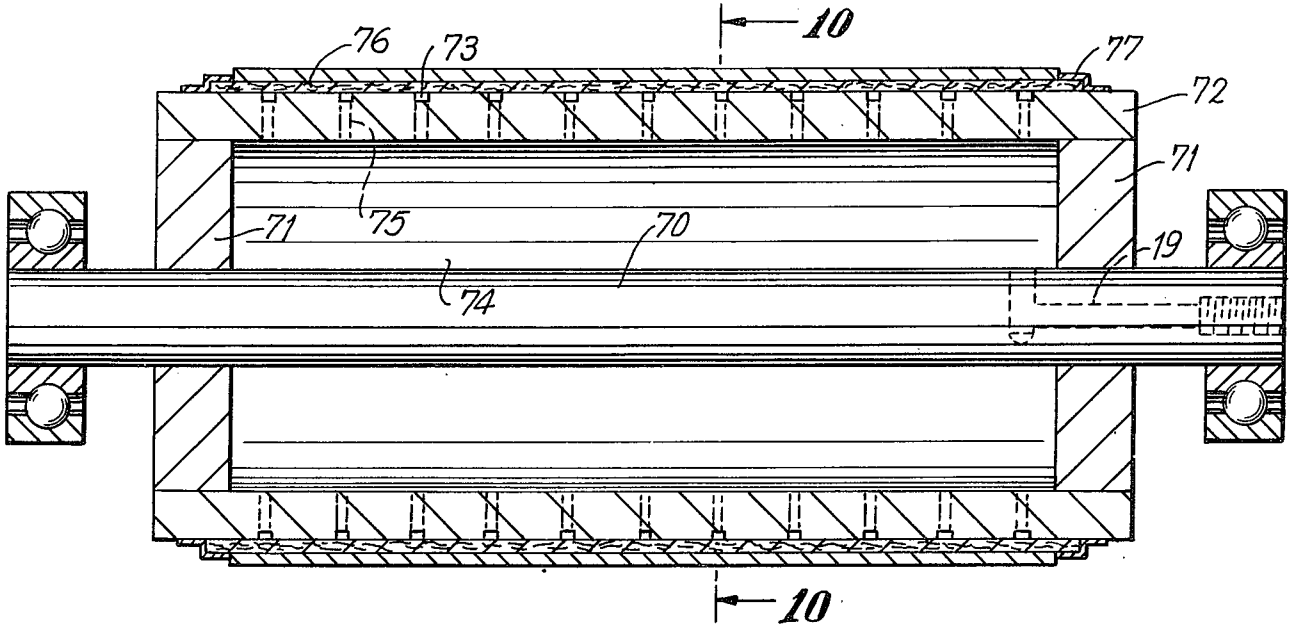
FIGS. 9 and 10 are longitudinal and transverse cross sectional views respectively of a modified form of vacuum-operated printing cylinder utilizing a layer of porous filter paper or the like interposed between the cylinder surface and the back of the printing plate.
Figure 10:
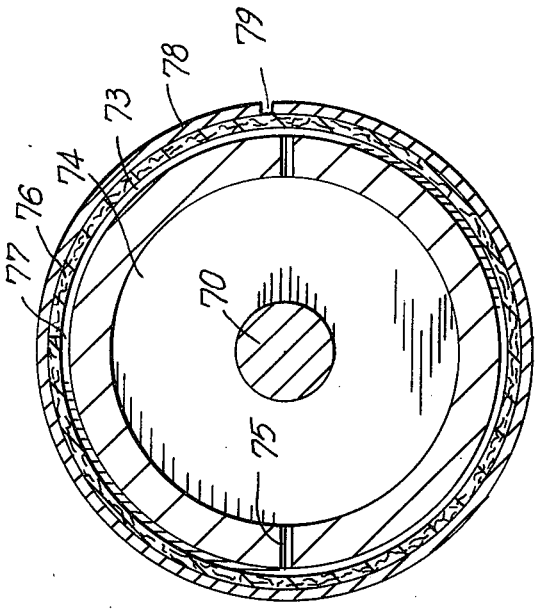

In the form of the invention shown in FIGS. 9 and 10, a printing cylinder assembly is provided, which includes a shaft 70, two or more supporting rings 71, and a cylinder sleeve 72. The sleeve shown to be provided with annular grooves 73 communicating with one or more interior chambers 74 through radial bores 75, as in the embodiment of FIGS. 6–8. It will be understood, however, that the vacuum passages may be in the form of a spaced pattern of radial bores, as in the embodiment of FIGS. 1–5, or in other suitable form.

Pursuant to the invention, in the modification of FIGS. 9 and 10, a sheet 76 of porous filter paper is wrapped about the exterior of the cylinder sleeve 72 and secured at its side edges, as by means of a suitable strip 77 of sealing tape. Desirably, the filter paper sheet 76 extends around the entire periphery of the cylinder, with the circumferential end edges substantially abutting, as at 77 (FIG. 10).

In the operation of the cylinder of FIGS. 9 and 10, the interior chamber 74 is evacuated through a passage 79 (it being understood that the interior of the cylinder may be subdivided into a plurality of chambers, if desired). A printing plate 78 is applied around the surface of the filter sheet 76 (see FIG. 10) with the end edges of the plate adjacent each other, as reflected at 79. The porous filter sheet 76 serves to diffuse and extend the area of evacuation underneath the printing plate 78, to increase the holding effectiveness of the cylinder. In addition, since any leakage of air around the edges of the printing plate must first pass through the filter sheet 76 before reaching the interior of the chamber 74 through the grooves 73 and bores 75, leakage flow is highly restricted, and leakage area is substantially less of a problem than otherwise. Thus, in the modification shown in FIGS. 9 and 10, when utilizing annular grooves 73 to provide the primary vacuum passages in the cylinder sleeve 72, it is possible to eliminate the longitudinal grooved and sealing strip arrangement provided in the modification of FIGS. 6-8. The gap at 79, between the ends of the printing plate, does not have serious adverse effects on the holding power of the cylinder, because of the generally restricted flow characteristics of the filter sheet 76.

One of the considerable advantages of the modification of FIGS. 9 and 10 resides in the fact that the filter sheet 76 may be changed to vary the thickness of the underlay for the printing plate. By way of example, certain types of printing plates, intended for long run work, may have substantial thickness, whereas inexpensive, short run plates are substantially thinner. These different plates may be accommodated in the modification of FIGS. 9 and 10, by utilizing filter sheets 76 of appropriate thickness, to maintain uniformity in the thickness of the overall combination of printing plate and filter sheet.

Figure 11:
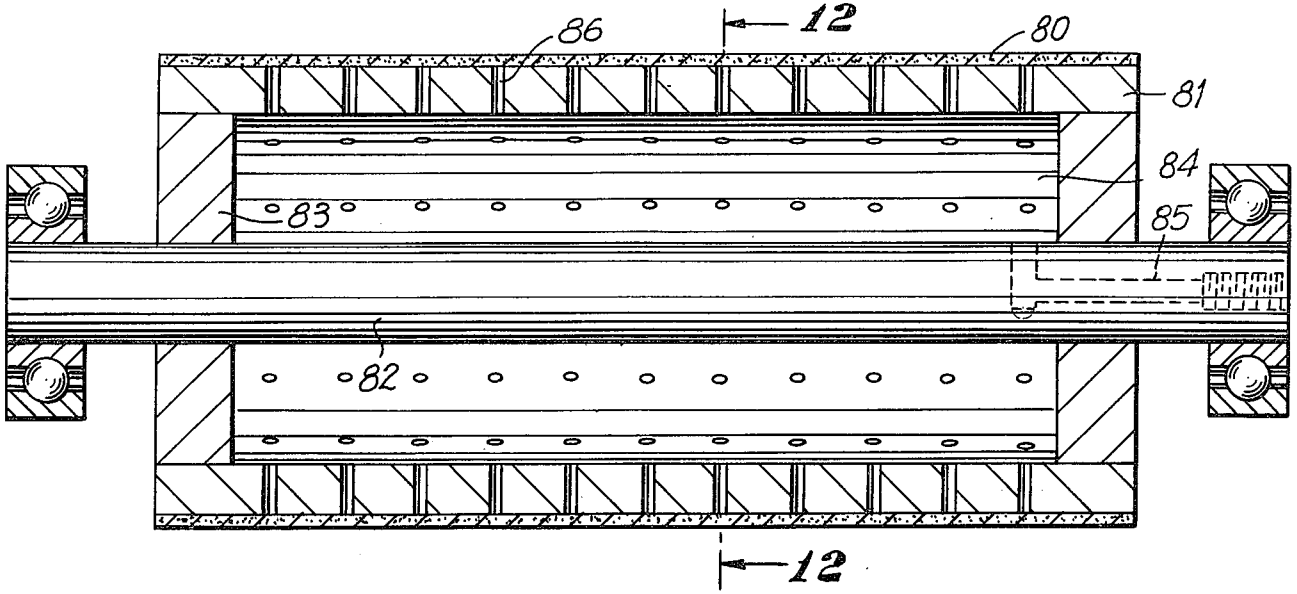
FIGS. 11 and 12 are longitudinal and transverse cross sectional views respectively of a further modified form of the new printing cylinder, in which the outer surface of the cylinder is provided with a sintered, porous coating layer for improved distribution of vacuum over the surface of the cylinder.
Figure 12:
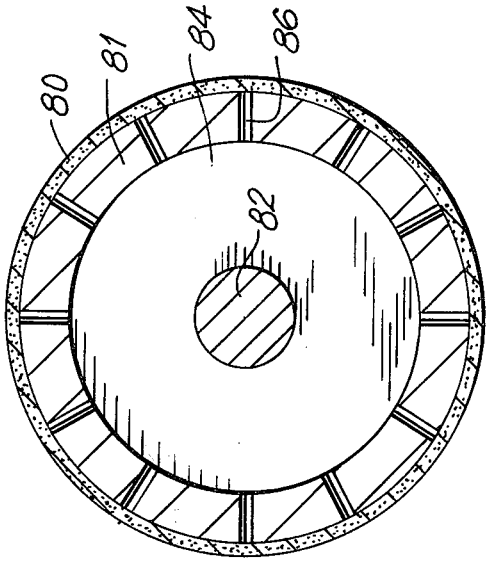

In the modification of FIGS. 11 and 12, a permanently bonded porous surface coating 80 is utilized, instead of the filter sheet 76 of the modification of FIGS. 9 and 10. The cylinder of FIGS. 11 and 12 includes a cylinder sleeve 81, forming with a shaft 82 and support rings 83 one or more internal chambers 84 arranged to coomunicate with a vacuum source through a passage 85. Most typically, the cylinder sleeve 81 is provided with a plurality of radial passage 86, more or less in a manner of the embodiment of FIGS. 1–5. The porous surface coating 80 is formed by the sintering of atomized metal particles, to achieve a continuous, porous layer of bonded particles. To advantage, the porous surface layer is formed and sintered in situ, and then machined to the desired outside diameter. In some cases, a sheet or cylinder of the sintered porous material may be formed separately and subsequently applied to the cylinder sleeve 81.

In the modification of FIGS. 11, 12 the sintered porous surface coating 80 serves to diffuse the vacuum effect over the entire under surface of the printing plate, for increased holding power, and also to limit and minimize the effect of leakage of air around the edge areas of the plate.

In any of its various forms, the invention provides a highly effective and entirely practical vacuum-operated printing cylinder, which meets the day-to-day practical needs of the printer. The specifices of the design of the cylinder are such as to permit the printing plates to be held by vacuum alone, without requiring auxiliary adhesive means, mechanical clamps, or the like. In part, this is realized by an effective configuration and arrangement of flow passages through the cylinder sleeve, to achieve effective distribution of the vacuum effect while avoiding problems from excessive leadkage. In the embodiment of FIGS. 1-5, and 6-8, important advantages are derived from the utilization of independently controllable vacuum chambers within the cylinder, which permit the application of vacuum to be confined more effectively to the size of the printing plate. This accommodates the use of smaller printing plates, as well as of multiple plates on a side-by-side basis. In the latter case, some of the plates can be removed and replaced without affecting the alignment of other plates, by maintaining the vacuum in certain chambers while removing it from others, as will be appreciated.

In any of the forms of the new printing cylinder in which the interior of the cylinder sleeve is subdivided into a plurality of chambers, it is advantageous to use a stepped construction, including a pre-assembly of shaft and supporting rings, with successive supporting rings increasing slightly in diameter form one end to the other. This arrangement, in conjunction with a correspondingly stepped internal configuration of the cylinder sleeve, provides a highly practical and effective arrangement for achieving a multi-chambered cylinder construction at a practical level of manufacturing cost. The arrangement further facilitates the provision of weight-balanced internal plumbing leading to the respective chambers, in conjunction with independently operated valve elements accessible from the end areas of the cylinder.

In the forms of the invention shown in FIGS. 9–12, the effectiveness of the applied vacuum is enhanced by the use of porous diffusion means, such as filter sheet or porous sintered metal. For some applications, the use of a replaceable filter sheet is particularly advantageous, in that filter sheets of varying thickness may be employed to accommodate the use of printing plates of various thickness (i.e., thinner filter sheets with thicker printing plates, and vice versa). When using porous diffusion means on the outer surface of the cylinder sleeve, minor leakages of air around the edges of the printing plate are of less concern, because the diffusing layer tends to inhibit the inflow of air sufficiently to limit leakage volume to practical levels in many instances.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A vacuum-operated printing cylinder, which comprises a. a shaft, b. a cylinder sleeve supported on said shaft and defining a vacuum chamber, c. a plurality of closely spaced, generally continuous annular grooves formed on the outer surface of said cylinder sleeve, d. air passage means connecting each of said annular grooves with said vacuum chamber, e. said cylinder sleeve having at least one axially disposed groove intersecting said annular grooves, f. axially disposed sealing strip means tightly received in and completely filling said axial groove, whereby said sealing strip means forms a continuation of the outer surface of the sleeve in the circumferential direction and blocks said annular grooves to provide a predetermined circumferential discontinuity between adjacent ends of each annular groove, and g. a printing plate mounted on the outer surface of said sleeve whereby said printing plate is held on said cylinder by the vacuum power of said chamber without the aid of mechanical clamping means, h. said printing plate being arranged so that the end edge portions thereof overlap said sealing strip means thereby avoiding leakage adjacent to the ends of the vacuum-held printing plate.

2. A vacuum-operated printing cylinder according to claim 1, further characterized by a said cylinder sleeve having a pair of axially disposed grooves spaced about 180° apart, b. said sealing strip means being tightly received in and completely filling each of said axial grooves to divide said annular grooves into semi-annular configuration, and c. air passage means connecting each semi-annular segment of said annular grooves with the interior of said cylinder.

3. A vacuum-operated printing cylinder which comprises a. a shaft, b. a cylinder sleeve surrounding said shaft, c. means subdividing the region between said shaft and sleeve into a plurality of evactuatable chambers, d. a primary evacuation passage extending internally of said shaft from adjacent one end thereof to a point adjacent to one end of the sleeve and spaced substantially from the other end of the sleeve, e. first valved passaged means connecting said primary passage means to one of said chambers and including a first valve element accessible from said one end of the sleeve, f. second valved passage means external of said shaft but within the confines of said sleeve for connecting said primary passage means to another of said chambers and including a second valve accessible from the other end of said sleeve, and g. said chambers each including passage means providing flow communication between said chambers and the exterior surface of said cylinder sleeve.

4. A vacuum-operated printing cylinder according to claim 3, further characterized by a. said second valved passage means including a section of substantially rigid tubing extending spirally around said shaft from one end to the other of said cylinder sleeve.

5. A vacuum-operated printing cylinder according to claim 4, further characterized by a. said subdividing means comprising a plurality of at least three sleeve supporting elements and including at least one intermediate sleeve supporting element, b. means forming an air passage transversely through said intermediate sleeve supporting element, and c. said tubing being connected to said last mentioned air passage at opposite sides of said intermediate sleeve supporting element.

6. A vacuum-operated printing cylinder according to claim 3, further characterized by a. said last-mentioned passage means including a plurality of radial bores formed in said cylinder sleeve, b. said sleeve having an axially disposed scribed line or the like for alignment of the edges of a printing plate, and c. there being a relative concentration of said radial bores in the immediate vicinity of said scribed line or the like providing increased holding power for the end edge areas of the printing plate in said vicinity.

* * * * *